106-97 AU 113 EX
2/22/83 OR 4,374,672

United States Patent [19]

Funston et al.

[11] 4,374,672

[45] Feb. 22, 1983

[54] METHOD OF AND COMPOSITION FOR PRODUCING A STABILIZED FILL MATERIAL

[75] Inventors: Joseph Funston, Detroit; William C. Krell, Grosse Pointe Woods; Franklin V. Zimmer, Southfield, all of Mich.

[73] Assignee: The Detroit Edison Company, Detroit, Mich.

[21] Appl. No.: 312,889

[22] Filed: Oct. 19, 1981

Related U.S. Application Data

[63] Continuation of Ser. No. 137,486, Apr. 4, 1980, abandoned.

[51] Int. Cl.[3] ..... C04B 7/02

[52] U.S. Cl. ..... 106/97; 106/DIG. 1; 405/129

[58] Field of Search ..... 106/97, DIG. 1; 405/128, 129, 266

[56] References Cited

U.S. PATENT DOCUMENTS 4,116,705 9/1978 Chappell ..... 106/DIG. 1

*Primary Examiner*—James Poer
*Attorney, Agent, or Firm*—Dale R. Small

[57] ABSTRACT

A stabilized fill material and method of producing the stabilized fill material comprising approximately 45–80% fly ash, 1–6% cement, and 20–50% water by weight, and mixing the material and depositing it directly in water by equipment supported on previously deposited fill material to form a causeway or the like. The fill material may include up to 2% lime by weight.

8 Claims, 3 Drawing Figures

METHOD OF AND COMPOSITION FOR PRODUCING A STABILIZED FILL MATERIAL

This is a continuation, of application Ser. No. 137,486 filed Apr. 4, 1980 now abandoned.

BACKGROUND OF THE INVENTION

1. Field of the Invention

The invention relates to stable fill materials and refers more specifically to a fill material having fly ash as its major constituent which may be positioned under water, in accordance with the method of the invention, to form a continuous causeway or the like.

2. Description of the Prior Art

In the past, fill material for depositing under water has generally consisted of rock, gravel and the like. Such material provides an adequate base for continued deposition of material from the water's edge so that a causeway or the like may be readily constructed over such fill material.

In the past, it has been considered that fills such as concrete fills for such causeways would require the construction of forms for the fills to prevent washing away of the fill material. Such fill material is not only expensive but in the past has not been practical due to the hardening time required for such fill material when provided in an economically feasible mix.

SUMMARY OF THE INVENTION

In accordance with the invention, fly ash from industrial furnaces or the like is mixed with a small amount of Portland cement and water and is continuously dumped into water at the edge thereof by structure supported on previously dumped fill material to form a causeway across the water. The fill material is approximately 45-80% fly ash, 1-6% cement, and 20-50% water by weight. Up to 2% lime may also be utilized. The fly ash may be eastern or western fly ash or a blend of the two.

DESCRIPTION OF THE PREFERRED EMBODIMENT

Figure 1:
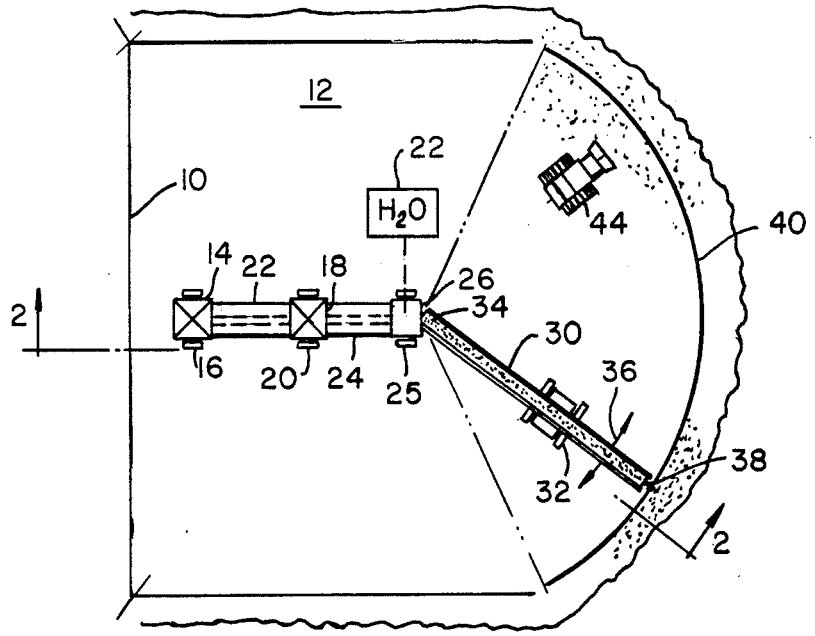
FIG. 1 is a plan view of a utilizing site for stabilized fill material showing the stabilized fill material in accordance with the invention deposited in accordance with the method of the invention.

In accordance with the method of the invention, a stabilized fill material is produced and deposited under water without forms or the like to construct a causeway across a body of water by equipment utilizing the fill material as it is deposited for support while carrying additional fill material to the water's edge and deposition of the additional fill material under water.

The fill material has a composition which is approximately 45-80% fly ash, 1-6% cement, and 20-50% water by weight. Up to 2% lime may also be present in the composition of the fill material. The fly ash utilized in producing the fill material may be eastern or western fly ash or a blend of the two.

The cement should be Portland cement Type I conforming to the specifications of A.S.T.M. C-150. Air entrained, Pozzolan cement and other types of cement are not recommended for use in the stabilized fill material of the invention.

Industrial fly ash such as that obtained from coal burning power plants may vary somewhat in chemical analysis and should meet the requirements of A.S.T.M. C-618, Type F. Fly ash from four separate sources suitable for use in the present invention has the following approximate chemical analysis:

| Chemical Analysis Constituent, % by weight | Source No. 1 | Source No. 2 | Source No. 3 | Source No. 4 |
|---|---|---|---|---|
| Carbon, C | 11.0 | 2.3 | 3.2 | 6.0 |
| Silica, $SiO_2$ | 62.5 | 42.8 | 41.3 | 62.0 |
| Alumina, $Al_2O_3$ | 27.9 | 19.5 | 19.6 | 21.2 |
| Iron Oxide, $Fe_2O_3$ | 5.2 | 5.2 | 22.7 | 4.9 |
| Magnesium Oxide, MgO | 0.8 | 2.9 | 1.4 | 1.1 |
| Calcium Oxide, CaO | 0.7 | 17.2 | 7.9 | 1.4 |
| Titanium Oxide, $TiO_2$ | 1.2 | 1.3 | 1.1 | 1.3 |
| Potassium Oxide, $K_2O$ | 1.2 | 0.3 | 1.9 | 1.4 |
| Sodium Oxide, $Na_2O$ | 0.5 | 8.8 | 1.0 | 0.7 |

Source No. 2 is a source of western fly ash. Sources Nos. 1, 3 and 4 are eastern fly ash. The western fly ash has pozzolanic properties not found in eastern fly ash and may be substituted for at least a portion of the cement in the fill material.

The fly ash from sources 1 through 4 has approximately the following sieve analysis. The percentages indicate that part of a sample which will be retained on a pass through a sieve of the particular mesh size indicated. 30 mesh screens have a pore size of 590 microns, 200 mesh screens have a pore size of 76 microns, and 325 mesh screens have a pore size of 44 microns.

| Wet Sieve Analysis, % by Weight | Source No. 1 | Source No. 2 | Source No. 3 | Source No. 4 |
|---|---|---|---|---|
| Retained 30 mesh | 0.5 | 0.6 | 22.2 | 2.2 |
| Passing 30 mesh | 99.5 | 99.4 | 77.8 | 97.8 |
| Retained 200 mesh | 21.5 | 6.0 | 53.9 | 18.1 |
| Passing 200 mesh | 78.5 | 94.0 | 46.1 | 81.9 |
| Retained 325 mesh | 30.5 | 23.3 | 65.4 | 31.6 |
| Passing 325 mesh | 69.5 | 76.7 | 34.6 | 68.4 |

Fill material made of the above composition and with fly ash having the above chemical and sieve analysis has properties as set forth in the following chart of unconfined compression tests utilizing standard six inch by 16 inch cylinders. Specifically, fly ash from source No. 4 was used in the compression tests with the percent moisture indicated:

| UNCONFINED COMPRESSION TESTS | | | | | |
|---|---|---|---|---|---|
| | % Cement | Slump | % Moisture | Test 7 Day | P.S.I. 28 Day |
| 1 | 3 | 3½ | 31.0 | 74 | |
| | | | | 78 | |
| | | | | 67 | |
| | | | | 65 | |
| 2 | 4.5 | 6 | 42.1 | 85 | 269 |
| | | | | 94 | 286 |
| 3 | 4.5/5.0 | 0 | 21 | 58 | |
| | | | | 62 | |
| | | 3¼ | 37 | 156 | |
| | | | | 149 | |
| 4 | 5.0 | 0 | 21 | 172 | |
| | | | | 119 | |

-continued

| | UNCONFINED COMPRESSION TESTS | | | | |
|---|---|---|---|---|---|
| | % Cement | Slump | % Moisture | Test 7 Day | P.S.I. 28 Day |
| | | | | 226 | |
| | | | | 229 | |
| | | | 25 | 106 | |
| | | 2½ | 33.0 | 138 | 159 |
| | | | | 131 | 202 |
| | | 8 | 34.9 | 134 | 168 |
| | | | | 102 | 200 |
| 5 | 5.5 | 8 | 37 | 110 | |
| | | | | 123 | |
| | | 7¼ | 35.5 | 198 | |
| | | 1¼ | 32.5 | 141 | 368 |
| | | | | 159 | 225 |
| 6 | 6.0 | 9 | 46.1 | | 219 |

The percentage of cement and moisture in the compression tests table above are percentages by weight. Where parameters are missing in the table, the parameters of the test are exactly the same as those next above. Thus, with test No. 3, for example, there were two test specimens in which the percent cement by weight was between 4.5 and 5%, the test specimen did not slump, and the percent moisture was 21% by weight. The seven-day compression test on these two specimens was 58 p.s.i. and 62 p.s.i., respectively. In test No. 1, two further test specimens were utilized, also having between 4.5 and 5% cement by weight, with a slump of 3¼ inches, a 37% moisture content by weight, and a seven-day compressive strength of 150 and 149 p.s.i., respectively.

Several tests were run utilizing different mixtures, based on dry weight, of the stabilized fill material as set forth below:

| | Mix 1 | Mix 2 | Mix 3 | Mix 4 |
|---|---|---|---|---|
| Eastern Fly Ash Approximately Source No. 4 | 95% | 96% | 96% | 96% |
| Cement | 5 | 4 | 3 | 2 |
| Lime | — | — | 2 | 2 |

Testing of the stabilized fill material having the above mixes was for cohesion characteristics at one day, compressive strength at 4, 28, 56 and 90 days, breakdown properties at one day when compacted in water, and pozzolanic activity or healing capability after breaking.

The compressive strength results of the above mixes were found to be as set forth in the following table:

| | 4 days | 28 days | 56 days | 90 days |
|---|---|---|---|---|
| Mix 1 | 127 psi | 207 psi | 208 psi | 256 psi |
| Mix 2 | 79 psi | 116 psi | 209 psi | 121 psi |
| Mix 3 | 65 psi | 147 psi | 133 psi | 203 psi |
| Mix 4 | 18 psi | 79 psi | 115 psi | 134 psi |

Cohesion characteristics were found to be good to fair at one day and to improve with increased cement content and age. All mixes appeared stable less than four hours after being placed in water. The stability improved with cement content and age. At approximately 80 days, mix No. 3 exhibited significant healing. At approximately 110 days, Mix No. 1 and Mix No. 3 appeared equal in strength.

A stablized fill material having the composition and properties set forth above may be utilized in accordance with the method of the invention with the equipment illustrated in the Figures.

Thus, with reference to FIG. 1, 10 is the bank of a river, canal or like body of water across which it is desired to build a causeway 12 of the stabilized fill material set forth above.

Fly ash as set forth above is stored in a hopper 14 on a truck bed 16 or the like. The fly ash in the hopper 14 may thus be moved outwardly as the causeway 12 is constructed. Hopper 18 is also positioned on a truck bed 20, again for movement along the causeway as the causeway is built. Hopper 18 is utilized for the storage of cement.

Fly ash from the hopper 14 is metered onto a conveyor 22 on which it is transported beneath hopper 18. At the hopper 18, cement is metered onto the conveyor 22. The combined fly ash and cement metered in the proper proportions as set forth above are transported by means of the conveyor 24 to the pug mill 26. Pug mill 26 may also be carried by a truck bed 25. If preferred, all of the hoppers 14 and 18, pug mill 26 and conveyors 22 and 24 may be carried on a single truck bed.

Water from a water source 28 is also metered into the pug mill 26 in accordance with the above composition of the stabilized fill material. The fly ash, cement and water are then thoroughly mixed in the pug mill 26.

The pug mill is then emptied onto a conveyor 30 which is supported by a carriage 32 for pivotal movement about the end 34 thereof in the direction of arrows 36 in FIG. 1. The outer end 38 thus traverses an arc 40 having a radius equal to the length of the conveyor 30 and a center at the end 34 of the conveyor 30 at the pug mill 26.

Figure 2:
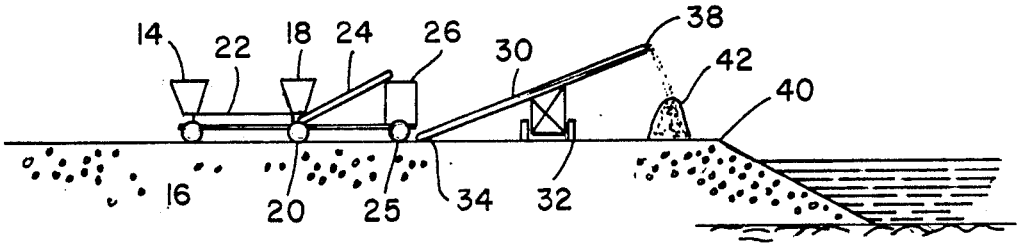
FIG. 2 is a partial section view of the site illustrated in FIG. 1, taken substantially on the line 2—2 in FIG. 1.

The mixed stabilized fill material may thus be deposited at the outer end of the causeway as it is being constructed in piles such as pile 42 shown in FIG. 2. The piles 42 are subsequently shoved into the water at the outer end of the causeway 12 by convenient means such as the small bulldozer 44 shown in FIG. 1.

Figure 3:
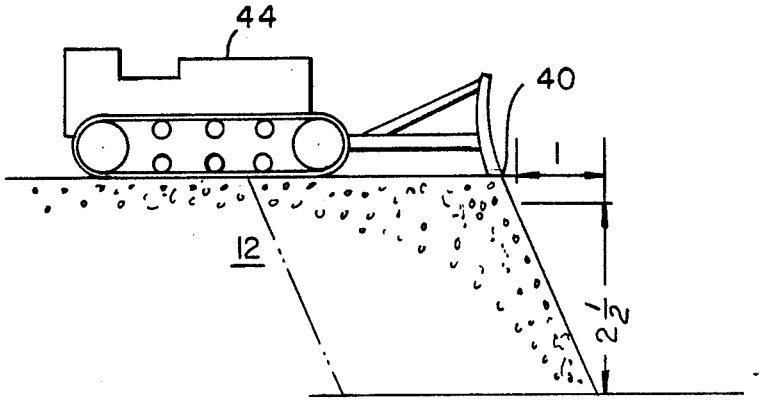
FIG. 3 is an elevation view of a small bulldozer utilized in the method of placing the fill material in accordance with the invention showing the approximate slope of the positioned fill material.

As shown in FIG. 3, the slope of the stabilized fill material has been found in one instance to be approximately 1 to 2½ in twenty feet of water. In other instances, the slope was as low as 1 to 1.

Further, it has been found that with proper timing, a continuous causeway construction operation may be accomplished with the truck beds, hoppers, conveyors and bulldozer operating on the stabilized fill material deposited in the water at the arcuate outer end of the causeway as it is being built as shown in FIG. 3. Accordingly, the causeway may be built without forms and without delays for hardening fill material to support equipment on.

Alternatively, it has been found that the stabilized fill material may be premixed at a remote location, trucked to the site of the causeway construction, tailgate dumped at the end of the causeway, and bulldozed in place in about twenty feet of open water. The stabilized fill material as set forth above is plastic, yet the structural integrity of the fill material will support a bulldozer while being placed to final grade. Further, the stabilized fill material as set forth has been subject to wave action without deterioration.

The invention is of particular importance since there is a current shortage of fill material such that the price of fill material, when available, is relatively high. The fill material of the invention is furthermore lighter than most available fill material and thus causes reduced backfill stresses (lateral pressures) against structures as well as reduced vertical pressure. It also has bridging capability. Also, and of great importance, the utilization of fly ash in the stabilized fill material provides a market for material which is presently an industrial waste which is difficult and expensive to dispose of.

While one embodiment and modifications of the present invention have been described in detail it will be understood that other embodiments and modifications are contemplated. Thus, the fill material of the invention is not limited in use to underwater placement. It is contemplated that the fill material of the invention may be utilized for sub-base and road beds and as backfill for commercial and residential buildings. Also other methods of mixing and placing are contemplated. It is the invention to include all such embodiments and modifications as are defined by the appended claims within the scope of the invention.

We claim:

1. A method of producing and placing a stabilized fill material in water comprising mixing cement, fly ash and water in predetermined portions of approximately 45–80% by weight fly ash, 1–6% by weight Portland cement, and 20–50% by weight water and placing the fill material so produced directly in water while it is still in a flowable state.

2. The method as set forth in claim 1, wherein the fill material further includes up to 2% by weight lime.

3. The method as set forth in claim 1, wherein the fill material is mixed at a site remote from the site where it is to be utilized, is trucked to the site where it is to be utilized, dumped at the edge of the water in which the fill material is to be placed and wherein the fill material is subsequently shoved into the water by means positioned on previous fill material hardened into a non flowable state.

4. The method as set forth in claim 1, wherein the fly ash and cement are fixed mixed by metering onto a traveling conveyor, the fly ash and cement are then conveyed to mixing structure where moisture is added to the mixed fly ash and cement and the mixed fill material is subsequently removed from the mixing structure for delivery to the utilizing site.

5. The method as set forth in claim 4, wherein delivery to the utilizing site is by mean of a conveyor and the removal of the mixed fill material from the pug mill is accomplished by dumping the fill material on one end of the conveyor and wherein the conveyor is pivoted about the one end thereof to provide an arc at the other end of the conveyor having the one end of the conveyor as its center and the conveyor at its radius, which arc defines the periphery of the utilizing site.

6. The method as set forth in claim 5, and further including moving the conveyors, mixing structure and storage hoppers for the cement and fly ash toward the arcuate periphery of the dumping site as the causeway construction progresses.

7. A method of producing and placing a stabilized fill material to construct a causeway across water or the like comprising mixture cement, fly ash, water and lime in the approximate proportions by weight 45–80% fly ash, 1–6% Portland cement, 20–50% water and 2% lime at a site remote from the site where it is to be utilized, trucking the fill material in a flowable state to the site where it is to be utilized, dumping the fill material while still in a flowable state at the edge of the water in which the fill material is to be placed and subsequently substantially immediately shoving the fill material still in a flowable state directly into the water by means positioned on previous fill material.

8. A method of producing and placing a stabilized fill material to construct a causeway across water or the like comprising mixing cement, fly ash, water and lime in the approximate proportions by weight 45–80% fly ash, 1–6% Portland cement, 20–50% water and 2% lime with the fly ash, cement and lime being first mixed by metering onto a traveling conveyor, conveying the mixed fly ash, cement and lime to mixing structure where moisture is added to the mixed fly ash, cement and lime, removing the mixed fill material in a flowable state from the mixing structure by dumping the fill material on one end of a conveyor and delivering the fill material to the utilizing site by means of the conveyor on which the fill material is dumped pivoted about the one end thereof to provide an arc at the other end of the conveyor on which the flowable fill material is dumped having the one end of the conveyor as its center and the conveyor as its radius which arc defines the periphery of the utilizing site, and moving the conveyors, mixing structure and storage hoppers for the cement, fly ash and lime toward the arcuate periphery of the dumping site as the causeway construction progresses.

* * * * *